United States Patent [19]

Hazbun et al.

[11] Patent Number: 4,770,670

[45] Date of Patent: Sep. 13, 1988

[54] FIRE RESISTANT MICROEMULSIONS CONTAINING PHENYL ALCOHOLS AS COSURFACTANTS

[75] Inventors: Edward A. Hazbun, Media, Pa.; Steven G. Schon, Dover, N.J.

[73] Assignee: Arco Chemical Company, Newtown Square, Pa.

[21] Appl. No.: 944,900

[22] Filed: Dec. 22, 1986

[51] Int. Cl.[4] ..... C10L 1/08; C10L 1/02

[52] U.S. Cl. ..... 44/51; 44/53

[58] Field of Search ..... 44/51, 53

[56] References Cited

U.S. PATENT DOCUMENTS

| | | | |
|---|---|---|---|
| 2,920,948 | 1/1960 | Weeks | 44/51 |
| 3,346,494 | 10/1967 | Robbins et al. | 44/51 |
| 3,527,581 | 9/1970 | Brownawell et al. | 44/51 |
| 4,002,435 | 1/1977 | Wenzel et al. | 44/53 |
| 4,083,698 | 4/1978 | Wenzel et al. | 44/51 |
| 4,451,265 | 5/1984 | Schwab | 44/51 |
| 4,451,267 | 5/1984 | Schwab et al. | 44/51 |
| 4,561,861 | 12/1985 | Davis et al. | 44/51 |
| 4,565,548 | 1/1986 | Davis et al. | 44/51 |
| 4,568,354 | 2/1986 | Davis et al. | 44/51 |
| 4,568,355 | 2/1986 | Davis et al. | 44/51 |
| 4,568,356 | 2/1986 | Chambers | 44/56 |
| 4,599,088 | 7/1986 | Davis et al. | 44/51 |

FOREIGN PATENT DOCUMENTS

| | | | |
|---|---|---|---|
| 2500844 | 9/1982 | France | 44/53 |
| 835038 | 7/1983 | South Africa . | |

OTHER PUBLICATIONS

Emulsions, Encyclopedia of Chemical Technology, Kirk-Othmer, 3rd Edition, vol. 8, p. 917.

The Condensed Chemical Dictionary, Tenth Edition, p. 121.

Encyclopedia of Chemistry, McGraw-Hill, p. 343.

*Primary Examiner*—William R. Dixon, Jr.

*Assistant Examiner*—Jerry D. Johnson

*Attorney, Agent, or Firm*—William C. Long

[57] ABSTRACT

Stable microemulsion compositions are provided especially fire resistant fuel compositions comprising (a) a hydrocarbon such as diesel fuel, jet fuel, gasoline, or fuel oil; (b) water; and (c) a novel cosurfactant combination of a phenyl alcohol and an ionic or nonionic surfactant. Methods are provided for destabilization and separation of the microemulsions directly before use.

9 Claims, No Drawings

FIRE RESISTANT MICROEMULSIONS CONTAINING PHENYL ALCOHOLS AS COSURFACTANTS

CROSS-REFERENCE TO RELATED APPLICATION

Co-pending application Ser. No. 825,841, filed Feb. 4, 1986, relates to improved microemulsion fuel formulations which contain a cosurfactant system of tertiary butyl alcohol in combination with one or more of an amphoteric, cationic, anionic or nonionic surface active agent.

BACKGROUND OF THE INVENTION

1. Field of the Invention

The invention relates to microemulsion compositions having improved flammability characteristics, and especially to fire resistant microemulsion fuel compositions—i.e., compositions which are not ignited by an open flame or pools of which are self-extinguishing following ignition. These compositions are of special importance in safety applications, for example, for use underground in mines, in combat vehicles, on aircraft carriers, and the like. In accordance with the present invention there are provided microemulsion compositions which have higher flash point characteristics thus providing improved flammability. In a special application microemulsion fuel compositions e.g., diesel formulations, are provided which are fire resistant.

2. Description of the Prior Art

Microemulsions are clear, stable, two-phase dispersions which form on simple stirring under appropriate conditions. Water in oil microemulsions (w/o) are comprised of a continuous non-polar hydrocarbon phase and a discontinuous aqueous phase. Because of the small droplet size of the discontinuous phase (2 to 200 nanometers) these microemulsions appear to be clear, one-phase systems.

The effects of water addition on diesel engine performance is reviewed in "Water and Alcohol Use in Automotive Diesel Engines", DOE/CS/50286-4, published September 1985 by J. J. Donnelly, Jr. and H. M. White. The techniques for introducing water into the engines covered by this review included (macro) emulsification, blending, fumigation, and dual-injection. The introduction of water was found to reduce emissions of smoke and particulates 20–60% while moderately reducing or increasing emissions of hydrocarbons and carbon monoxide. The addition of water also reduced levels of NOx 10–50%. This held true for all methods for introducing the water, and is attributed to a lowering of combustion temperatures (due to lower specific heating values and the heat absorbed to vaporize the water or alcohol droplets), and to a "microexplosion" phenomenon (the dispersed droplets vaporize explosively, more effectively atomizing the hydrocarbon fuel during combustion).

Water is most advantageously introduced into combustion engines dispersed in the hydrocarbon fuel as a microemulsion. Since microemulsions are clear, stable, and pre-blended (prior to being stored in the fuel tanks), there is no need for additional equipment on the vehicle (as would be required for the other methods) such as additional fuel metering systems (dual-injection), agitators inside the fuel tanks (to prevent separation of macroemulsion fuels), injection or fumigation devices, etc. At the same time, the water is still introduced into the engine in the desired physical form, i.e., as microscopically fine liquid droplets (albeit dispersed as micelles in the hydrocarbon), preserving the ability to vaporize in the desired "microexplosion" manner.

An excellent general treatment of the subject of microemulsion fuel compositions is "Microemulsion Fuels: Development and Use" ORNL TM-9603, published March 1985 by A. L. Compere et al. Again, the presence of water (in microemulsions) led to large reductions in smoke and particulates, with slight increases in hydrocarbons and CO emissions. Depending on the type of engine used and operating conditions, $NO_x$ emissions were moderately decreased or increased.

Research sponsored by the U.S. Army Fuels and Lubricants Research Laboratory investigated the effect of water-in-fuel microemulsions on the fire-safeness of combat fuels. Several reports by W. D. Weatherford, Jr. and coworkers (AFLRL reports Nos. 111, 130 and 145) document the effectiveness of microemulsion diesel fuels containing 1–10% water in reducing the flammability—fuel pools were either self-extinguishing following ignition, or could not be ignited by an open flame. The Army formulations were prepared with deionized water and surfactants without the addition of alcohols as cosurfactants. If low levels (200–500 ppm) of dissolved salts were present in the water, stable microemulsions could be formulated only by substantially increasing the percentage of surfactants, or by increasing the aromatic hydrocarbon content of the fuel. Even then, the amount of water that could be incorporated into the fuels were reduced when salts were present.

Various patents have issued which relate to microemulsion fuel compositions and which specifically relate to compositions comprised of hydrocarbon fuel, water, various alcohols, and surfactants. U.S. Pat. No. 4,046,519 for example, teaches a microemulsion fuel comprised of gasoline, methanol, water and a surfactant blend having a hydrophilic-lipophilic balance value of 3 to about 4.5. U.S. Pat. No. 4,083,698 describes fuel compositions which are water-in-oil emulsions and which comprise a hydrocarbon fuel such as gasoline or diesel fuel, water, a water-soluble alcohol such as methanol, ethanol or isopropanol, and certain combinations of surface-active agents. U.S. Pat. No. 4,451,265 describes microemulsion fuel compositions prepared from diesel fuel, water, lower water-miscible alcohols, and a surfactant system comprising N,N-dimethyl ethanolamine and a long-chain fatty acid substance. U.S. Pat. No. 4,451,267 teaches microemulsions prepared from vegetable oil, a C1–C3 alcohol, water and a lower trialkyl amine surfactant. This patent teaches the optional addition of 1-butanol as a cosurfactant for the purpose of lowering both the viscosity and the solidification temperature of the microemulsion.

U.S. Pat. Nos. 3,527,581 and 3,346,494 describe microemulsions of various fuels and lubricants using a particular combination of emulsifiers, one component of which is phenol containing a higher alkyl group substituent.

In co-pending application Ser. No. 825,841 filed Feb. 4, 1986, microemulsion compositions of improved stability are provided through use of a cosurfactant system containing tertiary butyl alcohol as one component. Although the formulations described in said co-pending application demonstrate superior stability, and substantial reduction in particulate and smoke emissions, they have low flash points and thus have flammability characteristics no different from the starting hydrocarbon fuels.

SUMMARY OF THE INVENTION

In accordance with the present invention, microemulsions are provided which retain the advantageous characteristic of stability, reduced emissions, and the like of prior formulations while demonstrating significantly improved flammability characteristics and fire resistance as a result of the incorporation therein of one or more phenyl alcohols as co-surfactant, with or without incorporation of lower alkyl alcohols as additional cosurfactants.

In addition, the invention provides for the destabilization of the microemulsions and separation of an aqueous phase from a hydrocarbon rich phase directly prior to use which is of special value in applications such as use in jet aircraft where performance characteristics of the fuel are exceptionally high.

DETAILED DESCRIPTION

In co-pending application Ser. No. 825,841 filed Feb. 4, 1986, there are described improved microemulsion formulations which contain a cosurfactant system of tertiary-butyl alcohol in combination with one or more of an amphoteric, cationic, anionic or nonionic surface active agent.

Other patents showing the use of lower alcohols in gasoline microemulsion formulations include U.S. Pat. Nos. 4,599,088; 4,561,861; 4,565,548; 4,568,354; 4,568,355 and 4,568,356.

Lower alkyl alcohols such as tertiary butyl alcohol, methanol, ethanol, propanol isopropanol, n-butanol, secbutanol, n-pertanol, isopentanol, tert-pentanol and the like typically have closed cup flash points below 100° F., i.e., are categorized as "flammable" materials. Microemulsions containing more than a few percent of these alcohols often also have flash points below 100° F., even if the other components have flash points above 100° F. (and are considered "combustible", rather than "flammable") or even if the other components are not flammable. Thus microemulsions prepared with more than a few percent lower alkyl alcohols may be classified as "flammable".

In certain applications, e.g., military "combat" fuels, jet fuels, metal working or cutting fluids, solvents, hard surface cleansers, hydraulic fluids, etc., it is desirable to use formulations that have a high flash point and/or are self-extinguishing when contacted by an ignition source or open flame. The fire-resistant properties of W/O microemulsions prepared without alcohols is discussed in several reports by W. D. Weatherford and coworkers at the U.S. Army Fuels and Lubricants Research Laboratory (AFLRL reports Nos. 111, 130 and 145).

According to the present invention microemulsions of the water in oil type (w/o) having improved fire resistance characteristics are provided wherein a novel cosurfactant combination is employed which is comprised of one or more phenyl alcohol in combination with one or more of an amphoteric, cationic, anionic or nonionic surface active agents. In an especially preferred embodiment, phenyl alcohols are substituted for some or all of the lower alkyl alcohols which were used in prior formulations such as those described in copending application 825,841 filed Feb. 4, 1986. The phenyl alcohols include benzyl alcohol, phenethyl alcohol, methyl benzyl alcohol, the phenyl propanol isomers, and the phenyl butanol isomers. Of these, methyl benzyl alcohol (MBA) and benzyl alcohol (BA) are preferred for reasons of cost and availability and because they have moderate water-solubility. It is the latter property which makes these alcohols especially suitable for use as a cosurfactant in microemulsions.

Phenyl alcohols have high flash points (greater than 180° F.), and thus do not significantly lower the flash point of microemulsions, even when used at relatively high concentrations. Microemulsions prepared from "combustible" components will, as a blend, retain the "combustible" classification. This is especially important for W/O microemulsions for applications requiring a high flash point and/or fire-extinguishing properties, such as fire-resistant fuels, metal working fluids, solvents, etc. W/O microemulsions using the high flash point phenyl alcohols can attain these desirable properties, whereas those using comparable amounts of low flash point lower alkyl alcohols would be classified as "flammable".

Blends of phenyl alcohols and lower alkyl alcohols may also be used as the cosurfactant in microemulsions. This may advantageously combine the desirable properties of both classes of alcohols, e.g., the low-temperature stability and/or tolerance of dissolved salts (in the water) associated with lower alcohols such as tert-butanol, n-butanol, isopropanol, etc., along with the higher flash points associated with phenyl alcohols such as MBA or BA. The flash point will be intermediate between those of microemulsions formulated with lower alkyl alcohols without phenyl alcohols and those of microemulsions formulated with phenyl alcohols (without lower alcohols) or with no alcohols.

In an especially preferred embodiment fire resistant diesel fuel microemulsions are obtained by incorporation in the microemulsion formulation of an effective amount of a phenyl alcohol as a cosurfactant. Such diesel fuels, for example, retain characteristics of decreased particulate and $No_x$ emissions by virtue of the added water, while demonstrating fire resistance in that the fuels are not ignited by open flame or pools of the fuels are self-extinguishing.

The present invention is applicable generally to hydrocarbons which have previously been used in microemulsions. Predominate among such microemulsions have been microemulsion diesel fuel formulations. However, the invention is applicable as well to microemulsions of jet fuel, fuel oil, gasoline, lubricating oil, metal working or cutting fluids, solvents, hydraulic fluids and the like.

The microemulsion compositions of the invention are clear and stable and exhibit the single phase properties of the continuous phase.

Fuel hydrocarbons which form the continuous phase in preferred embodiments comprise mixtures of hydrocarbons such as those derived from petroleum. The invention is especially useful with respect to diesel and jet fuel hydrocarbon formulations but the invention is also applicable to microemulsions formed of fuel oil hydrocarbons, gasoline hydrocarbons and the like. Compositions of the invention are readily used in place of the corresponding hydrocarbon fuels without the need for substantial changes in combustion apparatus, and demonstrate significantly improved stability characteristics over closely analagous prior compositions while retaining the important advantages demonstrated by prior formulations.

In water in oil microemulsions hydrocarbons comprise the predominant component of the microemulsion formulation. Generally speaking, the hydrocarbons comprise at least 50% by weight of the microemulsions and preferably comprise 60 to 90% by weight thereof.

Water forms a second essential component of such formulations, generally in amounts of 0.5 to 40% by weight, preferably about 2 to about 30% by weight, and more preferably about 3 to about 20% by weight. Larger amounts of water further reduce particulate and smoke emissions, but adversely effect temperature stability and power generation.

Essential to the invention is the provision of a cosurfactant composition comprising one or more phenyl alcohol in combination with an amphoteric, cationic, anionic or nonionic surfactant. Generally speaking, the invention involves modifying prior microemulsion formulations by the addition thereto or substitution therein of phenyl alcohol preferably in amounts of 1 to 30% by weight of the microemulsion and more preferably in amounts of 3 to 20% by weight.

The weight ratio of water to phenyl alcohol ranges from 1:10 to 5:1; preferred weight ratios range from 1:4 to 2:1 water:phenyl alcohol.

The phenyl alcohol is used in combination with surface active materials conventionally used in microemulsion formulations. Such conventional surface active materials are amphoteric, anionic, cationic or nonionic materials. Generally, these materials are used in amounts of 1 to 25% by weight of the microemulsion, preferably 3 to 20% by weight.

Amphoteric surface active materials preferably possess the betaine structure shown below.

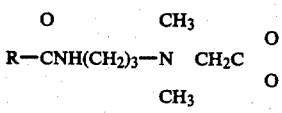

where $R=C_{11}-C_{17}$.

The cocoamidobetaines ($R=C_{11}$) available commercially are obtained as aqueous solutions containing 6% sodium chloride. For testing purposes, water and sodium chloride were removed before use. A typical formulation comprised by weight 65% No. 2 diesel fuel hydrocarbons, 5% water, 20% tertiary butyl alcohol, and 10% cocoamidobetaine demonstrated excellent stability over a wide range of temperatures. A betaine derived from oleic acid (unsaturated $C_{18}$ acid) gave similar good results.

Suitable nonionic surface active agents include ethoxylated alcohol derivatives, ethoxylated alkylphenols, pluronics and polyethoxylated carboxylate esters. Of the nonionics, the ethoxylated long chain primary alcohols were the most effective. A representative ethoxylated alcohol structure is shown below.

$$C_{12}H_{25}OCH_2CH_2OCH_2CH_2OCH_2CH_2OCH_2CH_2OCH_2CH_2OCH_2CH_2OH$$

Ethoxylated alcohols having HLB's (hydrophilic/lipophilic balance) from 7.9 to 14.4 were evaluated as surfactants. The best formulation consisted by weight of 75% diesel, 5% water, 10% n-butanol (NBA), and 10% Neodol 23-6.5 (HLB=12.0). Neodol 23-6.5 is a Shell trademark for a mixture of $C_{12}-C_{13}$ linear primary alcohol ethoxylates with an average of 6.5 ethylene oxide units per mole of alcohol.

Cationic surfactants which can be used include quaternary ammonium salt derivatives of the structures shown below.

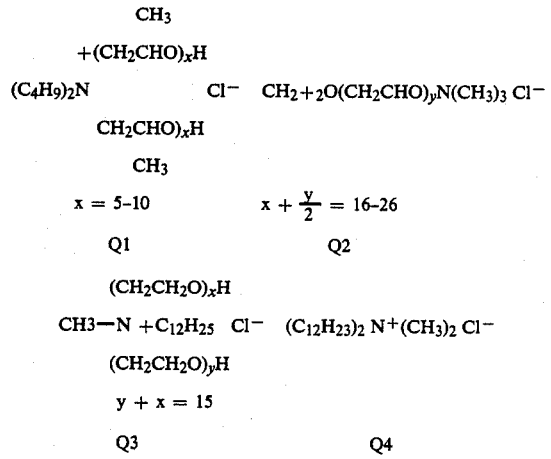

The cationics Q1 and Q2 represent propylene oxide derivatives of various quaternary ammonium compounds. They can be employed, for example, as the chloride or acetate salts. A Q2 type surfactant where the linear primary alcohol was a $C_{16}-C_{18}$ mixture of alcohols, having an average of four propylene oxide units attached and terminated with a quaternary ammonium group gave good results. A microemulsion comprised by weight of 75% No. 2 diesel hydrocarbons, 5% water, 10% tertiary butyl alcohol, and 10% of the Q2 surfactant was stable over a wide range of temperatures. Structures Q3 and Q4 were not as effective as structures Q1 and Q2.

Anionic surfactants are long chain carboxylic acids (i.e., fatty acids) which can be neutralized to varying degrees. For example, oleic acid, linoleic acid, stearic acid, isostearic acid, linolenic acid and palmitic acid and the like can be employed. As known in the art, neutralizing agents such as alkanol amines and inorganic bases may be employed.

When anionic surfactants are employed in watercontaining microemulsion fuels of this invention, uptake of water may be maximized by partially neutralizing the fatty acids: the degree of neutralization is preferably about 30 to about 65 mole %.

Water-containing microemulsion fuels preferably contain about 1 to about 20 (more preferably about 4 to about 12) % by weight phenyl alcohol, and about 2 to about 20 (more preferably about 5 to about 15) % by weight of at least one amphoteric, anionic, cationic or nonionic surfactant.

It is conventional to classify fuels and the like by flammability classifications according to flash point as follows:

| Flammability Classification | Flash Point (°F.) |
|---|---|
| Extremely Flammable | <32 |
| Highly Flammable | 32–73 |
| Flammable | 74–100 |
| Combustible | >100 |

In the following examples formulations were prepared using the components described in the following Table 1; also presented is the flash point for each component. The abbreviations indicated for each component are used in the examples to follow.

TABLE 1

| Component (Symbol) | Closed Cup Flash Point (°F.) |
|---|---|
| Diesel Fuel Oil, No. 2 | 136 |
| Monoethanolamine (MEA) | 185 |
| Emersol 315 | >300 |
| Methanol (MeOH) | 54 |
| Ethanol (EtOH) | 55 |
| Isopropanol (IPA) | 53 |
| n-Butanol (NBA) | 84 |
| Tert-Butanol (TBA) | 52 |
| n-Amyl Alcohol (NAA) | 91 |
| Tert-Amyl Alcohol (TAA) | 67 |
| Benzyl Alcohol (BA) | 213 |
| Methyl Benzyl Alcohol (MBA) | 185 |
| Phenethyl Alcohol (PEA) | 216 |
| Phenyl Propyl Alcohol (PPA) | 229 |

EXAMPLES 1-26

In order to illustrate the effect of different alcohol cosurfactants in diesel fuel microemulsion flash point, stable microemulsions were prepared using different alcohols and using varying amounts of the various components. The results are shown in the following Table 2 wherein examples 1-7, 14-16, 20-22 and 25-26 are in accordance with the present invention. The other examples are presented for comparison.

TABLE 2

| Example | Alcohols | Closed Cup Flash Point (°F.) |
|---|---|---|
| Microemulsion: 11.5 Wt % Water, 13.5 Wt % Surfactant*; 7.0 Wt % Alcohols, 68.0 Wt % Diesel | | |
| 1 | BA | >150 |
| 2 | MBA | >150 |
| 3 | PEA | >150 |
| 4 | PPA | >150 |
| 5 | 5.5 BA/1.5 TBA | 118 |
| 6 | 5.5 MBA/1.5 TBA | 115 |
| 7 | 5.5 MBA/1.5 MeOH | 130 |
| 8 | EtOH | 80 |
| 9 | IPA | 70 |
| 10 | NBA | 114 |
| 11 | TBA | 71 |
| 12 | NAA | 132 |
| 13 | TAA | 88 |
| Microemulsion: 2.0 Wt % Water, 5.0 Wt % Surfactant*, 2.5 Wt % Alcohols, 90.5 Wt % Diesel | | |
| 14 | MBA | >150 |
| 15 | 1.5 MBA/1.0 TBA | 112 |
| 16 | 1.5 MBA/1.0 MeOH | 120 |
| 17 | MeOH | 95 |
| 18 | TBA | 80 |
| 19 | NBA | 116 |
| Microemulsion: 6.0 Wt % Water, 10.0 Wt % Surfactant*, 5.0 Wt % Alcohols, 79.0 Wt % Diesel | | |
| 20 | MBA | >150 |
| 21 | 3.5 MBA/1.5 IPA | 111 |
| 22 | 3.5 MBA/1.5 TBA | 116 |
| 23 | IPA | 80 |
| 24 | TBA | 78 |
| Microemulsion: 20.0 Wt % Water, 24.0 Wt % Surfactant*, 7.5 Wt % Alcohols, 48.5 Wt % Diesel | | |
| 25 | PEA | >150 |
| 26 | BA | >150 |

*Emersol 315 40 mol percent neutralized with MEA.

From the above results it can be seen that the use of phenyl alcohol cosurfactants significantly raised the flash points of the diesel fuel microemulsions.

The stability of the above microemulsions prepared according to the invention was determined at temperatures ranging from −10° C. to 70° C. The results are shown in the following Table 3.

TABLE 3

| Example | Alcohols | Temperature Stability −10° C. | 0° C. | 20° C. | 50° C. | 70° C. |
|---|---|---|---|---|---|---|
| Microemulsion: 11.5 Wt % Water, 13.5 Wt % Surfactant*, 7.0 Wt % Alcohols, 68.0 Wt % Diesel | | | | | | |
| 1 | BA | F | + | + | + | + |
| 2 | MBA | F | + | + | S | S |
| 3 | PEA | F | + | + | + | + |
| 4 | PPA | F,X | X | + | + | + |
| 5 | 5.5 BA/1.5 TBA | F | + | + | + | X |
| 6 | 5.5 MBA/1.5 TBA | F | + | + | + | S |
| 7 | 5.5 MBA/1.5 MeOH | S | + | + | + | S |
| Microemulsion: 2.0 Wt % Water, 5.0 Wt % Surfactant*, 2.5 Wt % Alcohols, 90.5 Wt % Diesel | | | | | | |
| 14 | MBA | + | + | + | + | + |
| 15 | 1.5 MBA/1.0 TBA | + | + | + | + | X |
| 16 | 1.5 MBA/1.0 MeOH | + | + | + | X | X |
| Microemulsion: 6.0 Wt % Water, 10.0 Wt % Surfactant*, 5.0 Wt % Alcohols, 79.0 Wt % Diesel | | | | | | |
| 20 | MBA | F | + | + | + | + |
| 21 | 3.5 MBA 1.5 IPA | + | + | + | + | S |
| 22 | 3.5 MBA 1.5 TBA | + | + | + | + | + |
| Microemulsion: 20.0 Wt % Water, 24.0 Wt % Surfactant*, 7.5 Wt % Alcohols, 48.5 Wt % Diesel | | | | | | |
| 25 | PEA | F | + | + | + | S |
| 26 | BA | | | | | |

Legend:
+ Stable formulation (remains one clear phase after standing overnight.
S Clear when formulated; some sediment after standing overnight.
X Phase separation or opaque
F Frozen
*Emersol 315 40 mol percent neutralized with MEA.

Generally, the microemulsions of the invention were stable over the wide range of temperatures normally encountered during use.

Various microemulsion formulations were prepared using "brines" or water containing various levels of dissolved salts. As shown in the following table the phenyl alcoholcontaining microemulsions demonstrate good salt tolerance. This tolerance can be improved through use of the lower alkyl alcohols in combination with phenyl alcohols; indeed, the combination of lower alkyl alcohol with phenyl alcohol produced microemulsions which were stable over wider salt concentration ranges than microemulsions containing just phenyl alcohols or just lower alkyl alcohols. The results are given in Table 4 wherein Examples 27-30 and 32-33 are in accordance with the invention and Example 31 is presented for comparison.

TABLE 4

| Example | Alcohols | Stability with Aqueous Salt Solution NaCl 2500 ppm | NaCl 6500 ppm | $CaCl_2$ 2500 ppm | $CaCl_2$ 6500 ppm | $Mg_2So_4$ 2500 ppm | $Mg_2So_4$ 6500 ppm |
|---|---|---|---|---|---|---|---|
| Microemulsion: 6.0 Wt % Brine, 9.0 Wt % Surfactant*, 5.0 Wt % Alcohol, 80.0 Wt % Diesel | | | | | | | |
| 27 | BA | + | X | + | X | + | X |
| 28 | MBA | + | X | + | X | + | X |
| 29 | PEA | + | X | + | X | + | X |
| 30 | PPA | + | X | + | X | + | X |
| 31 | TBA | X | + | X | + | X | + |
| 32 | 3.5 BA/1.5 TBA | + | + | + | + | + | + |
| 33 | 3.5 MBA/1.5 | + | + | + | X | + | + |

TABLE 4-continued

| Example | Alcohols | Stability with Aqueous Salt Solution | | | | | |
|---|---|---|---|---|---|---|---|
| | | NaCl | | $CaCl_2$ | | $Mg_2So_4$ | |
| | | 2500 ppm | 6500 ppm | 2500 ppm | 6500 ppm | 2500 ppm | 6500 ppm |
| | TBA | | | | | | |

*Emersol 315 40 percent neutralized with MEA.
+ Stable formulation
X Phase separation or opaque The above examples show that W/O microemulsions that have high water loadings and broad temperature stability can be prepared using conventional microemulsion surfactants, and substituting phenyl alcohols for all or part of the aliphatic alcohols normally used as the cosurfactants. The substitution of the phenyl alcohols, especially benzyl alcohol, phenethyl alcohol, methyl benzyl alcohol, or phenyl propanol, results in improved fire safeness. Mixtures of phenyl alcohols and aliphatic alcohols may also be used in order to improve the temperature stability, salt tolerance, etc. compared to neat phenyl alcohol cosurfactants; flash points above 100° F. may be achieved for mixed alcohol cosurfactants by limiting the content of the (low-flash point) aliphatic alcohol to below 1–2 wt %, based on the total microemulsion compositions.

EXAMPLES 34–37

Cosurfactant combinations were prepared using components as set forth in the following Table 5:

TABLE 5

MICROEMULSIFIER PROPERTIES

| | Microemulsifier: | | | |
|---|---|---|---|---|
| | A | B | C | Comparison |
| | Weight % Composition | | | |
| Component | | | | |
| MBA | 34.1 | — | 26.8 | — |
| TBA | — | 10.0 | 7.3 | — |
| C18 Fatty Acid(1) | 60.6 | 82.8 | 60.6 | — |
| MEA(2) | 5.3 | 7.2 | 5.3 | — |
| Diethanol Oleamide(3) | — | — | — | 100 |
| Physical Property | | | | |
| Specific Gravity | 0.95(5) | 0.90(4) | 0.93(4) | 0.95 |
| Freezing Point (°C.) | −20 | −10 | −20 | <10 |
| Closed Cup Flash Point (°F.) | <165 | 62 | 82 | <165 |
| Viscosity @ 25° C. (Cp) | 43 | 86 | 39 | 31,500 |

(1)Emersol 315.
(2)Monoethanol Amine.
(3)Schercomid ODA (Scher Chemical Co.).
(4)Calculated specific gravity, assuming no volume change on mixing of the components.
(5)Manufactures Product data Diesel fuel microemulsions were prepared using the above surfactant combinations by hand stirring the components. Table 6 gives the various compositions:

TABLE 6

MICROEMULSION FUEL COMPOSITIONS

| | Example: | | | |
|---|---|---|---|---|
| | 34 | 35 | 36 | 37 |
| Component | Volume % Composition | | | |
| Water | 10.0 | 10.0 | 10.0 | 10.0 |
| Comparison Microemulsifier | 6.0 | — | — | — |
| Microemulsifier A | — | 18.8 | — | — |
| Microemulsifier B | — | — | 14.5 | — |
| Microemulsifier C | — | — | — | 19.2 |
| Aromatics Concentrate(1) | 6.0 | — | — | — |
| Diesel Fuel, No. 2 | 78.0 | 71.2 | 75.5 | 70.8 |
| Alcohol | Alcohol Content, Weight % | | | |
| MBA | — | 6.9 | — | 5.4 |
| TBA | — | — | 1.5 | 1.5 |
| Total | 0 | 6.9 | 1.5 | 6.9 |
| Closed Cup Flash Point (°F.) | 146 | 148 | 105 | 112 |

(1)Blend of benzene, toluene, xylenes (BTX) with 150° F. Flash Point

The microemulsions shown in Table 6 were tested for salt tolerance and flammability. At room temperature, the formulations of Examples 35–37 tolerated 1500 ppm NaCl in the water without phase separation. Example 37 containing 5.4 wt % MBA and 1.5 wt % TBA, was completely transparent. Example 36, containing 15 wt % TBA, was hazy but still transparent (it scattered light). Example 35, containing 6.9% MBA, was cloudy/translucent.

Bottles containing about 600 ml. of microemulision fuel samples were heated to 77° C. (170° F.) in a thermostatted bath, for at least 45 minutes and then poured into a thermostatted trough, ~36" long by 4" wide by ~½" deep (heated to 77° C.). A wick the width of the trough was placed ~¼" from one end of the trough. The wick was then lit at one end and the time for the flame to traverse the width of the wick was recorded. The pool was observed and timed for flash over and ignition. The test was stopped if ignition did not occur after ~15 minutes. The results are summarized in Table 7.

TABLE 7

POOL FLAMMABILITY TESTS

| Fuel | Wick Traverse (Min.) | Flashover (Min.) | Pool Fire (Min.) |
|---|---|---|---|
| Base Diesel | 0.3 | ? | 0.4 |
| Remarks: Pool ignited before the wick was fully burning. | | | |
| Example 34(1) | 0.4 | — | — |
| Remarks: Pool did not ignite. Fuel appears milky at 77° C. | | | |
| Example 35(2) | 0.4 | — | — |
| Remarks: Pool did not ignite. Fuel is clear at 77° C. | | | |
| Example 36(3) | 3.6 | — | — |
| Remarks: Pool did not ignite. Fuel is clear at 77° C. | | | |
| Example 37(3) | 0.4 | 1.0 (Partial Flash) | 3.1 |
| Remarks: Initially flashed over ~¼ of length of trough (~9 inches), but did not ignite fuel. Flashed over repeatedly for ~2 minutes before igniting the pool. Fuel is clear at 77° C. | | | |

(1)Prepared with deionized water
(2)Prepared with 1000 ppm NaCl in water.
(3)Prepared with 1500 ppm NaCl in water.

While the examples given above were based on diesel fuel and only one surfactant, it is evident to those skilled in the art of preparing microemulsions that the concept of the present invention is applicable to other hydrocarbon sources or fuels, e.g., gasoline, jet fuel, naphtha, fuel oil, petroleum fractions, coal-derived liquids, pure hydrocarbons, etc.; solvents, e.g., halohydrocarbons, or other materials which are used in W/O microemulsions; and other surfactants, including anionics, nonionics, cationics, and amphoterics.

The preferred ranges of loadings of water, surfactants, and cosurfactant phenyl alcohol or phenyl/lower alkyl alcohol blends are the same as those used when only lower alkyl alcohols are used as the cosurfactant.

The compositions of the present invention are especially advantageous for fire-resistant or self-extinguishing formulations that rely upon a high flash point and relatively high water content (3–20 wt % water, based on total formulation) to confer fire-resistant properties. This is especially useful for underground mining vehicles, for military diesel fuels, and commercial or military jet fuels, metal working fluids, hydraulic fluids, solvents, dry cleaning fluids, hard surface cleansers, etc.

The compositions of the present invention are especially advantageous for reducing the emissions and improving the thermal efficiency from automobile, diesel, jet, or other engines, stationary combustors, turbines and other devices that rely on the combustion of liquid hydrocarbon fuels.

While w/o microemulsion fuels of the invention are fire-resistant, it is not always desirable to operate a vehicle with the microemulsion; vehicle performance is superior when water and surfactants and cosurfactants are not present. Here, "vehicle" includes land vehicles, watercraft, and aircraft For example, the presence of water, and to a lesser extent, of surfactants, reduces the specific energy content (heating value) of the fuel, and thus the effective operating range of the vehicle. This is especially undesirable for military combat vehicles, e.g. tanks, armored personnel carriers, military aircraft, etc. Furthermore, at extremely low temperatures (below −10° to 20° C.), e.g. those encountered by high altitude aircraft, the microemulsions phase-separate due to freezing/crystallization of the microdispersed water and/or of the surfactants and/or cosurfactants. This phase separation can cause engine malfunction, with disastrous consequences.

The greatest risk of fire occurs in proximity to where the fuel is stored in bulk, due to the large volume of fuel, the larger container areas which are subject to leakage or penetration, and, for military situations, the larger and immobile target sites. Thus it is desirable to store fuels in bulk in a fire-resistant form, while using the base fuel in its substantially unadulterated form in the end use applications, i.e. in the vehicles.

In accordance with a particular feature of the invention, fuels are stored in bulk as fire resistant w/o microemulsions, using appropriate surfactants and cosurfactants to disperse the added water in the fuel. Immediate prior to transferring the fuel from bulk storage to the final user, e.g. to a vehicle, the microemulsion is "broken", i.e. destabilized by physical and/or chemical means to induce phase separation into a fuel-rich phase and an aqueous/surfactant phase. The phases are separated, and the fuel phase is fed forward to the final user, while the aqueous/surfactant phase is either discarded, or recovered and recycled to the bulk fuel storage system, so that additional (base) fuel may be rendered fire-resistant while in storage.

Destabilization may be achieved by various physical and/or chemical means, including, but not limited to the following:

A. Low temperature destabilization. The microemulsion is chilled to a sufficiently low temperature to cause the water as well as the surfactants and cosurfactants to phase separate by coalescence and/or freezing of the aqueous micelles. The microemulsion should be cooled to a temperature at or below the lowest expected operating temperature for the vehicle fuel system, to ensure that the remaining liquid fuel (after separation and recovery from the broken microemulsion) is not subject to further phase separation episodes during operation of the vehicle. It may be desirable to perform this operation in several stages of destabilization and separation, at progressively lower temperatures i.e. in the manner of fractional crystallization in staged operation, where the recovered fuel-rich phase from a preceding stage is chilled to a lower temperature, inducing destabilization or crystallization of water and/or surfactants and/or cosurfactants that remained microdispersed or dissolved in the fuel-rich phase recovered from the preceding stage.

B. High temperature destabilization. The microemulsion is heated to a sufficiently high temperature to cause the water as well as the surfactants and cosurfactants to phase separate, i.e. coalescence of the aqueous micelles, or boiling-off of the light components. This may be accomplished at elevated pressure, atmospheric pressure, or under vacuum. It may be desirable to perform this in staged operations, e.g. distillation or a series of evaporations.

C. pH Change. The effectiveness of the surfactants, especially anioinic surfactants (which are usually the preferred surfactants) often depends on the acidity of the system. The prior art has shown that there is an optimum range of neutralization for surfactant materials (e.g., fatty acids). Outside this optimum range, the water capacity of the microemulsion is dramatically reduced. Thus the microemulsion may be destabilized by adding excess acid, or excess base, or by removing the neutralizer, or by binding the surfactant. This may be achieved by any of the following means:

(a) Blowing an acid-forming gas (e.g. $CO_2$ or HCl) or gaseous base (e.g. NH3) through the liquid microemulsion; the gas is absorbed by and changes the acidity and destabilizing the microemulsion.

(b) Contacting the microemulsion with an ion exchange resin or series of resins. The ion exchanger(s) remove either the neutralizing base (using a cation exchange resin) or the precursor acid of the surfactant (using an anion exchange resin) from the microemulsion, changing the acidity and destabilizing the microemulsion.

(c) Contacting the microemulsion with a strong mineral acid or base.

(d) Removing a volatile neutralizer (e.g. $NH_3$) from the liquid by heating, and/or blowing a sweep gas ($N_2$, air, flue gas, etc.), and/or subjecting the microemulsion to a vacuum.

D. Saturation with water. If an excess of water is added to a microemulsion, the microdispersion capacity of the surfactants and cosurfactants is exceeded, and the micelles coalesce, resulting in a destabilized microemulsion.

E. Salting out. The presence of dissolved electrolytes (salts) can significantly reduce the water capacity of a microemulsion. The addition of salts or concentrated salt solutions to the microemulsion fuels will therefore destabilize the microemulsions.

Once the microemulsions are destabilized, the fuel phase and the aqueous/surfactant phases are readily separated by conventional process operations. These include, but are not limited to the following:

A. Filtration. This is especially useful when the water/surfactant phase occurs as solid particles, e.g. when the microemulsion is destabilized by chilling, and the water/surfactant/cosurfactant freezes or crystalizes.

B. Evaporation/Distillation. This is especially useful when the surfactant and cosurfactant have low volatility; the water and the fuel are boiled off, leaving the surfactant/cosurfactant as a solid or liquid residue; the vapors are condensed, with the water and fuel readily separating into two phases because of immiscibility in the absence of surfactants.

C. Centrifugation. This is especially useful when all of the phases present in the destabilized microemulsion are liquids; decanter-type centrifuges, e.g. "cream separators", are especially useful for achieving separation of the phases.

D. Sedimentation. This is especially useful when there is a substantial density difference between the phases, and when the water/surfactant phase appears as large particles or droplets.

In the following examples, water-in-fuel microemulsions were prepared using a microemulsifier, water, and a liquid hydrocarbon fuel. The microemulsifier consisted of 60.6 wt. % distilled tall oil fatty acids (Arizona Chemical FA-1) as the surfactant precursor, 5.3 wt. % monoethanolamine (Union Carbide) as the neutralizing agent, and 34.1 wt. % methyl benzyl alcohol (Fisher Chemical) as the cosurfactant.

Fire-Resistance of a Microemulsion Fuel

EXAMPLE 38

A water-in-diesel microemulsion was prepared using 10 vol. % distilled water, 18 vol. % microemulsifier, and 72 vol. % Phillips D-2 reference-grade certified diesel fuel. The components were hand-mixed, producing a transparent microemulsion fuel. Bottles containing 600 ml sample of either the microemulsion fuel or of the base diesel fuel were heated to 77° C. (170° F.) in a thermostatted bath for at least 45 minutes, and then poured into a thermostatted trough ~36" long by 4" wide by ~½" deep heated to 77° C. A wick the width of the trough was placed ~¼" from one end of the trough. The wick was then lit at one end and the time for the flame to traverse the width of the wick was recorded. The pool of fuel in the trough was observed and timed for flashover and ignition. The test was stopped if ignition did not occur after 5 minutes. With the base diesel fuel, the flame traversed the width of the wick in 0.3 minutes, and the pool ignited (flash over) before the wick was fully burning. The entire surface of the diesel fuel was burning 0.4 minutes after the wick was first lit. In contrast, with the water-in-diesel microemulsion, the wick traverse time was 0.4 minutes, and the fuel pool did not flash over or burn.

Destabilization and Phase Separation of a Microemulsion Fuel by Cold Crystallization

EXAMPLE 39

A water-in-jet fuel microemulsion was prepared using 10 vol. % distilled water, 13 vol. % microemulsifier, and 77 vol. % of a hydrocarbon mixture (Ashland 140) that meets the specifications for Jet A-1 fuel. The microemulsion was chilled to −18° C. (0° F.) in an isopropanol dry ice bath. Chilling the microemulsion caused freezing and crystallization to occur, resulting in an opaque slurry. The cold slurry was vacuum filtered through Whatman #12 filter paper using a Buchner funnel. The solids were completely removed by the filter paper, producing a clear filtrate. The solids were warmed to room temperature, producing a milky suspension. The filtrate was then chilled further to −40° C. (−40° F.). Solids precipitated out beginning at about −20° C. (−4° F.), although to a lesser extent than the first crystallization step. This colder slurry was also successfully vacuum filtered, producing a clear filtrate and a smaller crop of solids. Upon thawing, these solids also melted and produced a milky suspension. The second filtrate had a slight odor of methyl benzyl alcohol indicating that a small amount remained dissolved in the de-watered fuel.

Destabilization and Phase Separation of Microemulsion Fuels by Sparging an Acid-Forming Gas

EXAMPLE 40

Gaseous carbon dioxide ($CO_2$) was sparged through a sample of the microemulsion fuel of Example 39. $CO_2$ forms a weak acid (carbonic acid) in solution, and therefore changes the pH of the system. Within 30 seconds, the microemulsion was destabilized, changing from transparent microemulsion to an opaque suspension. The $CO_2$ sparging was continued for an additional 3 minutes. The suspension was then centrifuged for 5 minutes at 1400 rpm, which caused it to separate into a transparent yellow fuel-rich top layer, and an opaque off-white sediment containing water, surfactant, and cosurfactant. The fuel rich layer was decanted. Samples of the decanted fuel-rich layer, as well as the original microemulsion fuel were evaluated for temperature stability. The microemulsion became cloudy at ~−5° C., and froze completely at −10° C. In contrast, the decanted fuel-rich layer did not become cloudy until chilled below −11° C.; solids precipitated out when chilled to −15° C., but freeze-up of the entire sample did not occur, even when chilled to −30° C. These results indicate that the $CO_2$ treatment causes the water to separate from the fuel, although a portion of the surfactants and cosurfactant remained in solution in the fuel (and are what precipitated out when chilled to −15° C.); the use of lower-freezing point surfactants would confer even better low-temperature stability to the de-watered recovered fuel.

Destabilization and Phase Separation of Microemulsion Fuels by Addition of Mineral Acids 0.5 g of concentrated acid, either 38% hydrochloric acid (EXAMPLE 41), or 95.5% sulfuric acid (EXAMPLE 42) or 70.0% nitric microemulsion fuel of Example 39 (EXAMPLE 43). The microemulsoins were destabilized, changing from transparent microemulsions into turbid suspensions. The acidified suspensions separated on standing overnight, into a transparent pale yellow fuel-rich top layer, and a transparent yellow water/surfactant/cosurfactant-rich bottom layer.

The fuel-rich top layers of Examples 41, 42, and 43 were decanted and evaluated for temperature stability. All three of these remained transparent liquids, even when chilled to −20° C. In contrast, the original microemulsion fuel became cloudy when chilled to −5° C., and froze completely at −10° to −15° C. These results indicate that treatment of microemulsion fuels with strong mineral acids causes the water to be quantitatively removed from the recovered fuel-rich phase.

Recycle of Recovered Water/Microemulsifier for Use in Preparing Additional Microemulsion Fuel from Fresh Base Fuel

EXAMPLE 44

The thawed filter solids from both crystallization steps of Example 39 were combined and mixed with a volume of fresh jet fuel equal in volume to the amount of de-watered fuel recovered in Example 39. The mixture formed a lactescent emulsion. The mixture was titrated with a small amount of additional make-up cosurfactant (methyl benzyl alcohol), which converted the mixture into a transparent microemulsion.

EXAMPLE 45.

The sediment recovered from Example 40 was mixed with a volume of fresh jet fuel equal in volume to the amount of de-watered fuel recovered in Example 40. The mixture formed a lactescent emulsion. Gaseous nitrogen was then sparged through the mixture for 5 minutes to strip out the carbon dioxide (which is in equilibrium with carbonic acid) to de-acidify the mixture. This gas-stripping treatment converted the mixture into a slightly hazy, transparent microemulsion. The addition of 1 wt % make-up cosurfactant (methyl benzyl alcohol) clarified the new microemulsion completely.

As demonstrated by the above examples, the present invention offers the advantages of fire-resistant bulk storage of fuels (as w/o microemulsions), while avoiding the disadvantages (e.g. lower energy density, reduced operating range, low temperature instability, etc.) associated with operating vehicles with microemulsion fuels. The water and surfactants/cosurfactants are removed from the microemulsions immediately before loading the fuel onto the vehicles, by destabilizing the fire-resistant microemulsion form of the fuel used in bulk storage, separating the phases, and loading the recovered (de-watered) fuel onto the vehicles. The water and surfactants/cosurfactants recovered from the phase separation step can be reused with additional quantities of fresh fuel going to fire-resistant bulk storage. This recycle of surfactants and cosurfactants significantly reduces the costs and logistical requirements compared to using the microemulsions directly in the vehicles. Some additional water, surfactants, and cosurfactants may be required when recycling, to make-up for the amounts that remain in the de-watered fuel due to equilibrium considerations and inefficiencies in the phase-separation step.

Destabilization and phase separation and recovery is readily accomplished using conventional continuous processing equipment and readily available materials. This is carried out most advantageously using continuous processing equipment: the microemulsions are continuously pumped directly from bulk storage to the destabilization and phase separation equipment, and the recovered de-watered fuel is pumped directly into the vehicles.

We claim:

1. A fire resistant microemulsion diesel fuel composition comprising:

(a) at least 50% by weight of diesel fuel hydrocarbons;

(b) about 0.5 to about 40% by weight water; and (c) a surface active amount of a combination of surface active agents comprising:

(1) 1 to 30% by weight of the microemulsion of a phenyl alcohol; and (2) 1 to 25% by weight of the microemulsion of at least one amphoteric, anionic, cationic or nonionic surfactant.

2. The composition of claim 1 wherein the water:phenyl alcohol ratio is about 5:1.

3. A microemulsion fuel comprising:

(a) at least 50% by weight of a hydrocarbon fuel;

(b) about 1 to about 20% by weight water;

(c) about 1 to about 20% by weight of a phenyl alcohol; and (d) about 2 to about 20% by weight of at least one amphoteric, anionic, cationic or nonionic surfactant.

4. The composition of claim 3 wherein the hydrocarbon fuel is a diesel hydrocarbon fuel.

5. The composition of claim 3 wherein an anionic surfactant is used which is a partially neutralized fatty acid or fatty acid mixture.

6. The composition of claim 5 wherein the degree to which the fatty acid or fatty acid mixture is neutralized is about 30 to about 65 mole %.

7. The composition of claim 1 wherein the phenyl alcohol is methyl benzyl alcohol.

8. The composition of claim 1 wherein the phenyl alcohol is alpha phenyl ethanol.

9. A fire resistant microemulsion fuel composition with improved salt and temperature stability comprising:

(a) at least 50% by weight of a fuel hyrocarbon;

(b) about 0.5 to about 40% by weight water;

(c) a surface active amount of a combination of surface active agents comprising:

(1) 1 to 30% by weight of the microemulsion of a phenyl alcohol; and (2) 1 to 25% by weight of the microemulsion of at least one amphoteric, anionic, cationic or nonionic surfactant; and (d) 0.5 to 3% by weight of tertiary butyl alcohol, isopropyl alcohol or normal butyl alcohol.

* * * * *